US008696102B2

(12) United States Patent
Shimizu

(10) Patent No.: US 8,696,102 B2
(45) Date of Patent: Apr. 15, 2014

(54) PRINTING APPARATUS AND METHOD

(75) Inventor: Seiji Shimizu, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 12/885,866

(22) Filed: Sep. 20, 2010

(65) Prior Publication Data

US 2011/0069129 A1 Mar. 24, 2011

(30) Foreign Application Priority Data

Sep. 24, 2009 (JP) ..... 2009-218810

(51) Int. Cl.

| | |
|---|---|
| ***B41J 2/01*** | (2006.01) |
| ***B41J 2/14*** | (2006.01) |
| ***B41J 2/06*** | (2006.01) |
| ***B41J 2/435*** | (2006.01) |

(52) U.S. Cl.
USPC ..... 347/102; 347/47; 347/55; 347/224

(58) Field of Classification Search
None
See application file for complete search history.

(56) References Cited

U.S. PATENT DOCUMENTS

| | | | | |
|---|---|---|---|---|
| 7,360,887 | B2 | 4/2008 | Konno | |
| 7,789,502 | B2 | 9/2010 | Domoto et al. | |
| 8,192,012 | B2 | 6/2012 | Domoto et al. | |
| 2001/0022607 | A1 * | 9/2001 | Takahashi et al. | 347/103 |
| 2005/0212852 | A1 | 9/2005 | Konno | |
| 2006/0066704 | A1 | 3/2006 | Nishida | |
| 2007/0120930 | A1 * | 5/2007 | Domoto et al. | 347/102 |
| 2008/0062241 | A1 * | 3/2008 | Yamashita et al. | 347/224 |
| 2009/0237479 | A1 * | 9/2009 | Yamashita et al. | 347/103 |
| 2010/0177151 | A1 * | 7/2010 | Thompson et al. | 347/102 |
| 2010/0295913 | A1 | 11/2010 | Domoto et al. | |

FOREIGN PATENT DOCUMENTS

| | | | |
|---|---|---|---|
| JP | 6015853 | A | 1/1994 |
| JP | 6218960 | A | 8/1994 |
| JP | 10-250052 | A | 9/1998 |
| JP | 2001-179960 | A | 7/2001 |
| JP | 2005-271480 | A | 10/2005 |
| JP | 2006-123537 | A | 5/2006 |
| JP | 2007-152945 | A | 6/2007 |
| JP | 2007-301993 | A | 11/2007 |
| JP | 2009072975 | A | 4/2009 |

OTHER PUBLICATIONS

Notice of Reasons for Rejection issued in corresponding Japanese Patent Application No. 2009-218810 mailed Mar. 26, 2013.

* cited by examiner

*Primary Examiner* — Stephen Meier
*Assistant Examiner* — Alexander C Witkowski
(74) *Attorney, Agent, or Firm* — Banner & Witcoff, Ltd.

(57) ABSTRACT

A printing apparatus and method may provide efficient transfer of ink from a transfer belt to a recording sheet by using a transfer mechanism having a supporting member for supporting the recording sheet and a contact member. In one arrangement, the contact member may be configured to contact an inner peripheral surface of the transfer belt to bend the transfer belt and push the outer peripheral surface of the belt outward at an angle smaller than 90°. By pushing and bending the transfer belt, the an ink transfer surface of the belt and the recording sheet may be pinched together to affect transfer of the image.

16 Claims, 3 Drawing Sheets

PRINTING APPARATUS AND METHOD

CROSS REFERENCE TO RELATED APPLICATION

This application claims priority to Japanese Patent Application No. 2009-218810, filed Sep. 24, 2009, the entire subject matter and disclosure of which is incorporated herein by reference.

BACKGROUND OF THE DISCLOSURE

1. Field of the Disclosure

The features described herein relate generally to printing an image on a printing medium such as a recording sheet by discharging liquid from a liquid discharge head onto a transfer member and transferring the liquid attached to the transfer member to the printing medium.

2. Description of Related Art

Known ink-jet printers may be configured to transfer ink to a recording medium such as paper. More specifically, ink drops are discharged from an ink-jet head to an outer peripheral surface of a transfer member, thereby causing ink to attach to the outer peripheral surface. The ink is then caused to be attached or transferred to the paper by pressing the paper against the outer peripheral surface of the transfer member (or vice versa). The ink which is attached to the paper is then separated from the outer peripheral surface of the transfer member together with the paper.

In ink-jet printers such as the printers described above, the change of the curvature of the transfer member when the ink attached to the paper is separated from the outer peripheral surface of the transfer member is obtuse. Therefore, some of the ink might not separate from the outer peripheral surface of the transfer member upon contact with and subsequent separation of the paper.

SUMMARY OF THE DISCLOSURE

According to one or more aspects described herein, a printing apparatus may comprise an endless transfer belt which is configured to rotate in a peripheral direction. The printing apparatus may also comprise a print head which is configured to discharge light-cured liquid onto an outer peripheral surface of the transfer belt. The printing apparatus may further comprise a transfer mechanism which is configured to transfer the light-cured liquid which is attached to the outer peripheral surface of the transfer belt to a printing medium by contacting the printing medium with the outer peripheral surface of the transfer belt. In one example, the printing medium may be brought into contact with the transfer belt. In another example, the transfer belt may be brought into contact with the printing medium. In yet other examples, both the transfer belt and the printing medium may be moved to contact one another. The printing apparatus may further comprise a first irradiation unit which is configured to irradiate the printing medium having the light-cured liquid transferred thereto with light for curing the light-cured liquid. The transfer mechanism may comprise a supporting member which is configured to support the printing medium. The transfer mechanism may also comprise a contact member, which is configured to contact an inner peripheral surface of the transfer belt to bend the transfer belt by pushing the outer peripheral surface outward at an angle smaller than 90°, and pinch the transfer belt and the recording medium with the supporting member therebetween.

According to another aspect, a printing method for printing an image on a printing medium may comprise discharging light-cured liquid from a print head configured to discharge light-cured liquid onto an outer peripheral surface of an endless transfer belt. The endless transfer belt may be configured to rotate in around a periphery of an area defined by transfer and conveying rollers. The printing method may further include transferring the light-cured liquid attached to the outer peripheral surface of the transfer belt to the printing medium by bringing the printing medium into contact with the outer peripheral surface of the transfer belt. Additionally, the printing method may include contacting a contact member to an inner peripheral surface of the transfer belt to bend the transfer belt. For example, the transfer belt may be bent by pushing the outer peripheral surface outward at an angle less than 90°, and pinching the transfer belt and the recording medium between the contact member and a supporting member configured to support the printing medium. The printing method may yet further include, in one or more arrangements, irradiating the printing medium having the light-cured liquid transferred thereto with light for curing the light-cured liquid from a first irradiation unit.

Other objects, features and advantages will be apparent to persons of ordinary skill in the art from the following description with reference to the accompanying drawings.

BRIEF DESCRIPTION OF THE DRAWINGS

Embodiments of a printing apparatus and a printing method are described with reference to the accompanying drawings, which are given by way of example only, and are not intended to limit the present patent.

DETAILED DESCRIPTION

Figure 1:
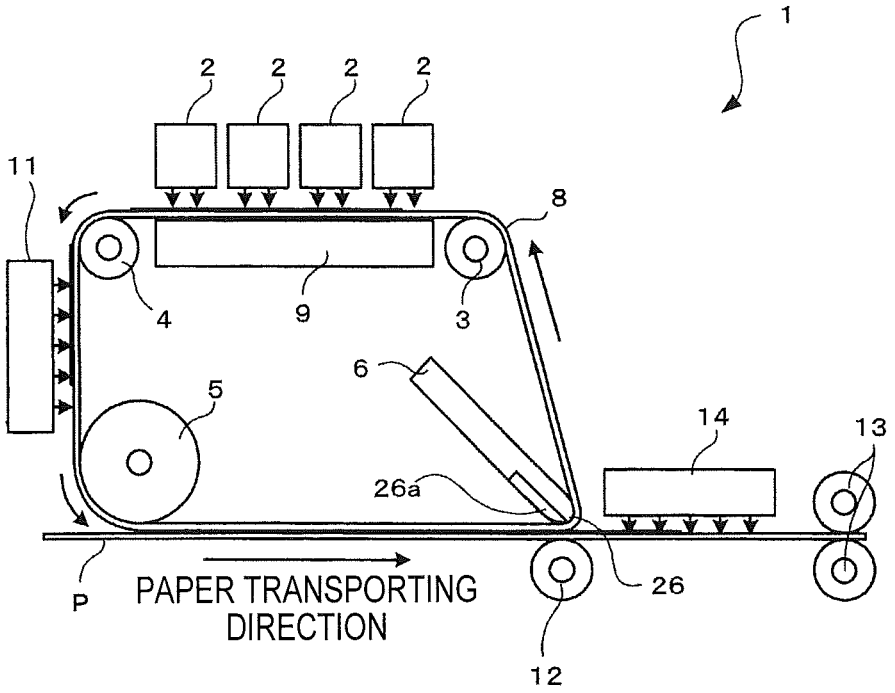
FIG. 1 is a schematic side view of an ink-jet printer according to one or more aspects described herein.
Figure 2:
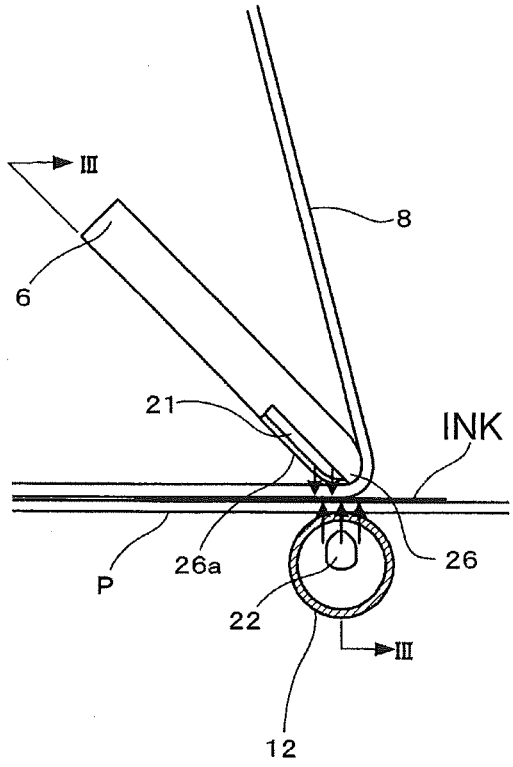
FIG. 2 is a partially enlarged view of the ink-jet printer shown in FIG. 1.
Figure 3:
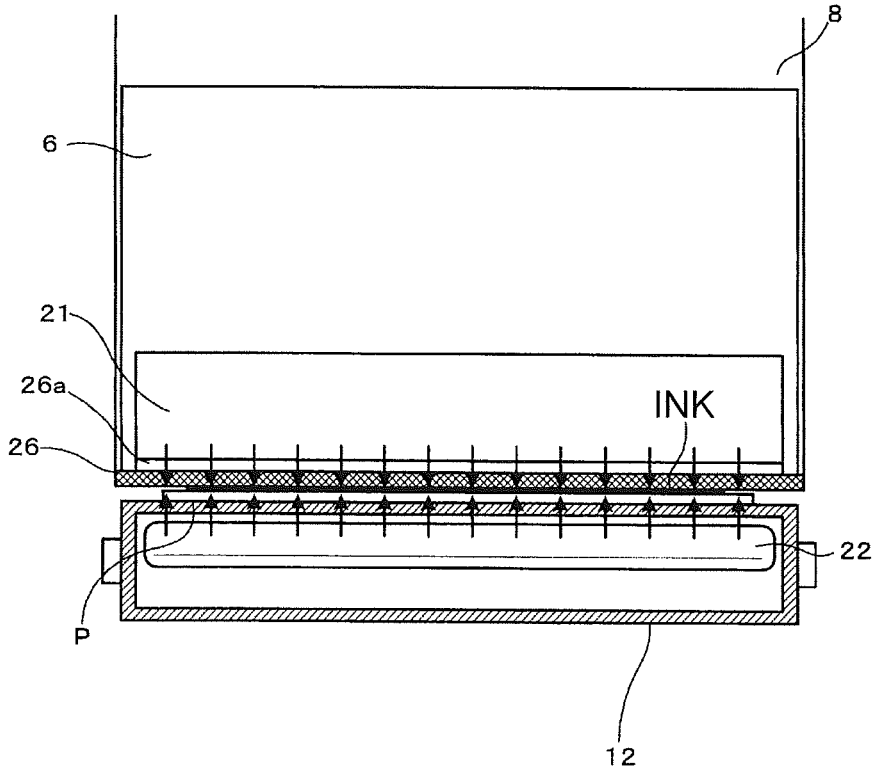
FIG. 3 is a cross-sectional view of the ink-jet printer of FIGS. 1 and 2 taken along the line III-III in FIG. 2.

Various aspects, features and advantages, may be understood by referring to FIGS. 1-3, like numerals being used for corresponding parts in the various drawings.

Referring to FIG. 1, an ink-jet printer 1 according to an embodiment may include a plurality of ink-jet head 2*s*, an endless transfer belt 8, a platen 9, a semi-curing irradiation device 11, a pressurizing roller 12, nip rollers 13, and a completely curing irradiation device 14. In the illustrative example of FIG. 1, the ink-jet printer 1 may include four ink-jet heads. However, any number (e.g., 1, 2, 3, 5, 6, 7) of ink-jet heads may be used. According to one arrangement, a sub scanning direction is a direction parallel to the direction of rotation of the transfer belt, and a main scanning direction is a direction along the horizontal plane and orthogonal to the sub scanning direction.

The plurality of ink-jet heads 2 may discharge ink drops in various colors such as magenta, cyan, yellow, and black. The ink discharged by the ink-jet heads 2 may be light-cured by being irradiated with UV (i.e., Ultra Violet) light. The ink-jet heads 2 each may extend along the main scanning direction, and may be arranged parallel to each other in the sub scanning direction. The ink-jet printer 1 may be a line-type ink-jet color printer in which a plurality of discharge ports for discharging ink drops are arranged in the main scanning direction. Lower surfaces of the ink-jet heads 2 may be configured as discharge surfaces including the plurality of discharge ports for discharging ink drops. The respective discharge surfaces of the plurality of ink-jet heads 2 may face the outer peripheral surface of the upper loop portion of the transfer belt 8 with a predetermined clearance therebetween. The outer peripheral surface may include the surface of transfer belt 8 facing away from an interior of a loop formed thereby.

The transfer belt 8 may be constructed with a transparent member which allows UV light to pass therethrough. The transfer belt 8 may be wound around a plurality of belt rollers 3 to 5, and a distal end portion of a separation blade 6. In the illustrative example of FIG. 1, 3 belt rollers (i.e., belt rollers 3, 4 and 5) are used. However, fewer or additional rollers may be used. The belt roller 5 may be a driving roller which rotates by being applied with a drive force from a transporting motor. The belt rollers 3 and 4 may be driven rollers which rotate in association with the transfer belt 8 being travelled by the rotation of the belt roller 5. For example, rotation of driver rollers 3 and 4 may be actuated or caused by movement of transfer belt 8. When the belt roller 5 is driven, the transfer belt 8 may travel so as to rotate counterclockwise as illustrated in FIG. 1.

Referring to FIG. 2 and FIG. 3, the separation blade 6 may have a substantially flat-panel shape extending in a widthwise direction of the transfer belt 8 (i.e., main scanning direction). A distal end of the separation blade 6 may be formed with a curved surface 26. The surface of the separation blade 6 opposing the transfer belt 8 (i.e., the surface facing leftward in FIG. 2) may be formed with an irradiation port 26*a*. The irradiation port 26*a* may have a predetermined width from the distal end thereof. In one arrangement, the irradiation port 26*a* may be formed over substantially the entire surface of separation blade 6 facing away from transfer belt 8 with the exception of the end portions of the separation blade 6 in the longitudinal direction.

The curved surface 26 may, in one or more configurations, contact an inner peripheral surface of the transfer belt 8 (shown in the lower right portion of FIG. 2). The separation blade 6 may bend the transfer belt 8 upward while pushing the outer peripheral surface outward such that the inner angle of the transfer belt 8 is less than 90° (e.g., 60°). The transfer belt 8 may further slide with respect to the curved surface 26 as the transfer belt 8 travels.

A blade-side irradiation device 21 configured to emit UV light downward from irradiation port 26*a* may be disposed in the separation blade 6. For example, the blade-side irradiation device 21 may be positioned on the upstream side of separation blade 6 relative to the direction of rotation of transfer belt 8 (e.g., upstream side relative to the transport direction of paper P) with respect to a point where the curved surface 26 and the inner peripheral surface of the transfer belt 8 contact one another. Accordingly, the area on the outer peripheral surface of the transfer belt 8 where the paper P contacts transfer belt 8 may be irradiated with the UV light emitted from the blade-side irradiation device 21. At this time, in a preliminary step toward separation of the paper P from transfer belt 8, the UV light may cure the portion (e.g., an interface portion) of the light-cured liquid that interfaces or is in contact with the side of the transfer belt 8.

A platen 9 (as shown in FIG. 1) may be positioned so as that an upper surface thereof may come into contact with the upper inner peripheral surface of the transfer belt 8 extending in the horizontal direction. The platen 9 may support the transfer belt 8 from the inner peripheral surface side of belt 8. Accordingly, the upper outer peripheral surface of the transfer belt 8 may extend in parallel to the discharge surfaces of the ink-jet heads 2, and a predetermined clearance suitable for forming the image may be provided. The ink drops in the various ink colors may be discharged from the respective ink-jet heads 2 in a specified sequence toward the outer peripheral surface of the transfer belt 8 while causing the transfer belt 8 to travel. Accordingly, the ink may be attached to the outer peripheral surface of the transfer belt 8, thereby forming a color image (i.e., inverted image) on belt 8 before transfer to the paper P.

According to another aspect, a semi-curing irradiation device 11 may be positioned so as to face the outer peripheral surface of the transfer belt 8 extending in the vertical direction (e.g., as shown on the left side in FIG. 1). The semi-curing irradiation device 11 may be positioned proximate (e.g., adjacent) to a portion of the transfer belt 8 disposed between a position opposing the ink-jet heads 2 to a position opposing the separation blade 6 in the direction of rotation of the transfer belt 8. The semi-curing irradiation device 11 may be configured to irradiate the outer peripheral surface (e.g., surface of the belt 8 facing away from an interior region defined by the transfer belt 8) of the transfer belt 8 with the UV light. The UV light emitted from the semi-curing irradiation device 11 may have a light intensity sufficient to make the ink which is attached to the outer peripheral surface of the transfer belt 8 into a semi-cured state.

Additionally, a pressurizing roller 12 may be positioned on a side of transfer belt 8 opposite the curved surface 26 of the separation blade 6. The paper P, as a printing medium, may be transported by a paper transporting device from the left to the right according to the orientation shown in FIG. 2 so that a surface of paper P on which an image is to be recorded faces the lower horizontally extending outer peripheral surface of the transfer belt 8. The pressurizing roller 12 may be configured to pinch the fed paper P in conjunction with the transfer belt 8 between the curved surface 26 of the separation blade 6 and the roller 12. Accordingly, the transported paper P may be pressurized or pressed against the outer peripheral surface of the transfer belt 8, thereby transferring the ink attached to the outer peripheral surface of the transfer belt 8 to a printing surface of the paper P. Then, by bending the transfer belt 8 upward, the ink which is attached to the outer peripheral surface of the transfer belt may be separated from the outer peripheral surface in conjunction with the paper P and may be transferred to the printing surface of the paper P.

An outer peripheral wall of the pressurizing roller 12 may be configured with a transparent member which allows UV light to pass therethrough. In one or more arrangements, a roller-side irradiation device 22 may be disposed within (e.g., in the interior of) the pressurizing roller 12. The roller-side irradiation device 22 may be configured to emit UV light upward toward the outer peripheral surface of the transfer belt 8. The UV light irradiated from the roller-side irradiation device 22 may pass through the outer peripheral wall of the pressurizing roller 12 and may reach the paper P being pressurized against the outer peripheral surface of the opposing transfer belt 8. The UV light reaching the paper P may further pass through the paper P and cause the ink transferred to the printing surface to be cured. In this manner, the UV light irradiated from the roller-side irradiation device 22 may reach the ink by passing through the paper P. Therefore, in some arrangements or examples, the ink may be cured more efficiently by using a UV transparency of the paper to allow UV light to pass therethrough and cure the ink adhered thereto. For example, if the paper P is a sheet or a roll member configured of transparent material other than paper (e.g., a resin material or the like), the ink may be cured more efficiently than in the case where the sheet formed of paper is used.

Referring again to FIG. 1, a final curing irradiation device 14 may be positioned so as to face a printing surface of paper P and downstream (i.e., rightward in FIG. 1) from having the ink transferred to the printing surface. For example, the final curing irradiation device 14 may be located downstream in a sheet conveying direction from roller 12 and blade 6. The final curing irradiation device 14 may be configured to irradiate the printing surface of the paper P having the ink transferred thereto with UV light. The UV light emitted from irradiation device 14 may have a light intensity sufficient to completely cure the ink attached to the printing surface of paper P. In this manner, a desired image is formed on the printing surface by the ink transferred to the printing surface of the paper P fixed thereto.

Nip rollers 13 may be a pair of rollers which are configured to pinch the paper P having the image printed thereon. The nip rollers 13 may transport the paper P having the ink transferred thereto further downstream (i.e., rightward in FIG. 1), and may output paper P with the printed image to an output tray.

The following description relates to a printing operation of the ink-jet printer 1. With continued reference to FIG. 1, when printing is started, the belt roller 5 may be driven and the transfer belt 8 may move or travel counterclockwise. After having stabilized the traveling of the transfer belt 8, the ink drops in various colors may be discharged from the respective ink-jet heads 2 in sequence toward the outer peripheral surface of the transfer belt 8. The ink may adhere or be attached to the outer peripheral surface of the transfer belt 8 after being discharged and contacting the outer peripheral surface.

When the transfer belt 8 travels further ahead or downstream, the outer peripheral surface of the transfer belt 8 on which the ink is attached may pass through an area facing the semi-curing irradiation device 11 (i.e., leftward of the transfer belt 8 in FIG. 1). At this point, the ink attached to the outer peripheral surface of the transfer belt 8 may be irradiated with UV light emitted from the semi-curing irradiation device 11, such that the ink is brought into the semi-cured state. By bringing the ink into the semi-cured state, the pattern of the ink attached to the outer peripheral surface of the transfer belt 8 may be prevented from being broken away (e.g., from the surface of belt 8) before being transferred to the paper P.

Subsequently, the paper P as a printing medium may be transported by the transporting device so as to oppose or face the outer peripheral surface of the transfer belt 8 extending horizontally at lower portion thereof (i.e., from the left to the right in FIG. 1). When the transfer belt 8 travels further ahead, the ink in the semi-cured state which is attached to the outer peripheral surface of the transfer belt 8 may move at the same speed as the paper P while facing the desired position on a printing surface of the paper P (i.e., from the left to the right in FIG. 1). Subsequently, the paper P may be pinched between the curved surface 26 of the separation blade 6 and the pressurizing roller 12 in conjunction with the transfer belt 8. By pinching or pressing the paper and the transfer belt 8, the transported paper P may be pressed against the outer peripheral surface of the transfer belt 8. At this point, the ink in the semi-cured state attached to the outer peripheral surface of the transfer belt 8 may be transferred and attached to the printing surface of the paper P.

In one or more arrangement, the ink, immediately before being attached to the paper P, may be irradiated with the UV light from the blade-side irradiation device 21 via the transfer belt 8 from above, and with the UV light from the roller-side irradiation device 22 from below. When being irradiated with the UV light from the blade-side irradiation device 21, the portion of the ink coming into contact with the outer peripheral surface of the transfer belt 8 may be cured and contracted. The transfer belt 8 might not change by being irradiated with the UV light, so that the ink may be separated easily from the outer peripheral surface of the transfer belt 8. Likewise, when being irradiated with the UV light from the roller-side irradiation device 22, curing of the ink is affected to allow easier separation of the ink from the outer peripheral surface of the transfer belt 8.

Then, the curved surface 26 of the separation blade 6 may bend the transfer belt 8 steeply upward while pushing the outer peripheral surface thereof outward, such that the inner angle of the transfer belt 8 becomes 60°. Therefore, the ink transferred to the printing surface of the paper P may be separated from the outer peripheral surface of the transfer belt 8 in conjunction with the paper P and may be transferred to the paper P.

The paper P having the ink transferred to the printing surface may be transported further (i.e., rightward in FIG. 1), and may pass under the completely curing irradiation device 14. At this time, the ink transferred to the printing surface of the paper P may be brought into the completely cured state by the UV light irradiated from the completely curing irradiation device 14. Accordingly, a desired image may be fixed to the printing surface.

The paper P on which the image is fixed may be pinched by the nip rollers 13, and may be output to the output tray. Thus, the printing on the paper P may be completed.

As described above, according to the embodiment of the ink-jet printer 1, the ink transferred from the outer peripheral surface of the transfer belt 8 to the paper P may be separated reliably by the separation blade 6 bending the transfer belt 8 at an angle of 60°. Accordingly, the ink which is attached to the outer peripheral surface may be reliably transferred to the paper P and the quality of the image to be printed on the paper P may be restrained from being degraded.

Since the transfer belt 8 is configured of the transparent member which allows the UV light to pass therethrough, the UV light from the blade-side irradiation device 21, which is irradiated from the inside the transfer belt 8, may be allowed to reach the ink which is attached to the outer peripheral surface of the transfer belt 8 efficiently.

Since the blade-side irradiation device 21 which is disposed in the separation blade 6 emits the UV light from the inside the transfer belt 8, the portion of the ink transferred to the printing surface of the paper P which comes into contact with the outer peripheral surface of the transfer belt 8 may be cured and contracted. Accordingly, the ink may be separated easily from the outer peripheral surface of the transfer belt 8, and the ink which is attached to the outer peripheral surface of the transfer belt 8 may be transferred to the paper P further reliably. Since the blade-side irradiation device 21 is supported in the separation blade 6, downsizing of the ink-jet printer 1 may be achieved.

At this point, the blade-side irradiation device 21 may emit the UV light toward the area of the outer peripheral surface of the transfer belt 8 where the paper P comes into contact therewith. The blade-side irradiation device 21 may further be positioned on the upstream side of blade 6 relative to the direction of rotation of the transfer belt 8 and with respect to the location where the curved surface 26 and the inner peripheral surface of the transfer belt 8 contact one another. Therefore, the ink may be irradiated with the UV light immediately before the paper P is separated from the outer peripheral surface of the transfer belt 8. This immediate curing and separate process may allow ink which comes into contact with the outer peripheral surface of the transfer belt 8 to be cured efficiently.

Since the ink is brought to a semi-cured state before being transferred to the paper P, break-up or break-away of the ink pattern attached to the outer peripheral surface of the transfer belt 8 by vibrations or the like before being transferred to the paper P may be prevented.

Moreover, since the roller-side irradiation device 22 disposed inside the pressurizing roller 12 irradiates the ink with UV light before (and in some cases immediately before) being separated from the transfer belt 8, the curing of the ink may be accelerated, such that ink is easily separated from the outer peripheral surface of the transfer belt 8.

In the examples described above, the blade-side irradiation device 21 is disposed in the separation blade 6 and emits UV light from inside the transfer belt 8. In an alternate arrangement, however, the blade-side irradiation device may correspond to an irradiation device configured to emit from within a region defined by (e.g., bounded by) the transfer belt 8, may be positioned proximate or adjacent to a portion of the transfer belt 8 disposed between a position opposing the ink-jet heads 2 to a position opposing the separation blade 6 in the direction of rotation of the transfer belt 8. In this case, the irradiation device may be supported by at least one of the belt rollers 4 and 5 which are configured in the same manner as the pressurizing roller 12. The irradiation device may be supported separately from the belt roller. Alternatively, the ink-jet printer may have a configuration having no blade-side irradiation device.

In the examples described above, the semi-curing irradiation device 11 emits the UV light from the outside the transfer belt 8 to bring the ink attached to the outer peripheral surface of the transfer belt 8 into the semi-cured state. However, the semi-curing irradiation device 11 may be configured to emit the UV light from inside the transfer belt 8 (e.g., from an interior of a loop formed by belt 8). Alternatively, the ink-jet printer may have a configuration having no semi-curing irradiation device 11.

In the embodiment described above, the roller-side irradiation device 22 which is disposed in the pressurizing roller 12 irradiates the ink which is attached to the paper P with the UV light. However, the roller-side irradiation device 22 does not have to be disposed in the pressurizing roller 12. The ink-jet printer may have a configuration having no roller-side irradiation device 22.

In the examples described above, separation and transfer of the image on the transfer belt 8 are performed substantially simultaneously by pinching the paper P between the separation blade 6 and the pressurizing roller 12. However, a configuration in which the functions of the separation and the transfer are separated (e.g., performed in a non-simultaneous or non-substantially simultaneous manner or in sequence) is also applicable. For example, the transfer process may be performed on the upstream side of the separation blade 6. At this point, the image may be transferred by pinching the transfer belt 8 and the paper P between the plurality of, e.g., two, pressurizing rollers 12. It may be configured to perform the separation of the paper P (i.e., image) using the separation blade 6 of the invention on the downstream side.

In the embodiment described above, a piezoelectric system is assumed as the discharging mechanism of the ink-jet heads 2. However, the discharging mechanism is not limited thereto. It may be an electrostatic system.

In the examples described above, the ink-jet heads 2 may comprise line-type heads fixed to the ink-jet printer. However, in other examples, the ink-jet heads 2 may comprise serial type ink-jet heads in which the head is scanned together with the carriage.

The invention is applicable to a printing apparatus which is configured to transfer heat-cured liquid other than ink to the printing medium. In addition, the invention is not limited to the printer and is applicable to a facsimile machine, a copying machine and so on.

While the invention has been described in connection with various exemplary structures and illustrative embodiments, it will be understood by those skilled in the art that other variations and modifications of the structures and embodiments described above may be made without departing from the scope of the invention. Other Structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A printing apparatus comprising:

an endless transfer belt configured to rotate;

a print head configured to discharge light-curable liquid onto an outer peripheral surface of the transfer belt;

a transfer mechanism configured to transfer the light-curable liquid attached to the outer peripheral surface of the transfer belt to a printing medium by bringing the printing medium into contact with the outer peripheral surface of the transfer belt;

a first irradiation unit configured to cure the light-curable liquid attached to the printing medium by irradiating the printing medium using light; and a second irradiation unit configured to emit light, from an interior side of the transfer belt, for curing the light-curable liquid when the liquid is attached to the transfer belt, wherein the transfer mechanism comprises:

a supporting member configured to support the printing medium; and a non-rotational contact member configured to contact an inner peripheral surface of the transfer belt at a point of the transfer belt to bend the transfer belt outward such that an interior angle formed by the transfer belt at the contact point is less than 90° and wherein the non-rotational contact member is configured to pinch the transfer belt and the recording medium between the supporting member and the non-rotational contact member, wherein the second irradiation unit is disposed in the non-rotational contact member and configured to emit the light toward a portion of the transfer belt upstream, in a direction of rotation of the transfer belt, of the contact point.

2. The printing apparatus according to claim 1, wherein the transfer belt comprises a material which allows the light to pass through.

3. The printing apparatus according to claim 1, wherein the second irradiation unit is configured to emit the light toward an area of the outer peripheral surface of the transfer belt where the printing medium comes into contact with the transfer belt.

4. The printing apparatus according to claim 1, further comprising a third irradiation unit located proximate to a portion of the transfer belt disposed between a position opposing the print head and a position opposing the non-rotational contact member in the direction of rotation of the transfer belt, and is configured to emit light for curing the light-curable liquid such that the light-curable liquid which is discharged on the transfer belt is caused to be semi-cured.

5. The printing apparatus according to claim 4, further comprising a fourth irradiation unit disposed in the supporting member, wherein the fourth irradiation unit is configured to irradiate the printing medium supported by the supporting member with additional light for curing the light-cured liquid.

6. The printing apparatus according to claim 1, wherein the light for curing the light-curable liquid emitted from the first irradiation unit is ultra violet light.

7. The printing apparatus according to claim 6, wherein the light-curable liquid which is discharged from the print head is ultra-violet-light-curable ink.

8. The printing apparatus according to claim 1, wherein the non-rotational contact member is configured to contact the inner peripheral surface of the transfer belt and to bend the transfer belt at an angle of less than or equal to 60°.

9. The printing apparatus of claim 1, wherein the second irradiation unit is disposed at an angle relative to the portion of the transfer belt upstream of the contact point.

10. A printing method comprising:

discharging light-curable liquid from a print head onto an outer peripheral surface of an endless transfer belt configured to rotate;

curing, by a first irradiation unit, the light-curable liquid when the liquid is attached to the transfer belt by emitting light, from an interior side of the transfer belt, wherein the second irradiation unit is disposed in a non-rotational contact member;

transferring the light-curable liquid attached to the outer peripheral surface of the transfer belt to the printing medium by contacting the non-rotational contact member to an inner peripheral surface of the transfer belt at a contact point, thereby bending the transfer belt, pushing the outer peripheral surface toward the printing medium and pinching the transfer belt and the recording medium between the non-rotational contact member and a supporting member configured to support the printing medium, wherein an interior angle formed by the transfer belt at the contact point is less than 90°; and irradiating the printing medium having the light-curable liquid transferred thereto with light for curing the light-curable liquid by emitting light, from a second irradiation unit, toward a portion of the transfer belt upstream, in a direction of rotation of the transfer belt, of the contact point.

11. The printing method according to claim 10, wherein the transfer belt comprises a material which allows the light to pass through.

12. The printing method according to claim 10, further comprising:

emitting light for curing the light-curable liquid such that the light-curable liquid discharged on the transfer belt is caused to be semi-cured from a third irradiation unit, wherein the third irradiation unit is located proximate to a portion of the transfer belt disposed between a position opposing the print head and a position opposing the non-rotational contact member in a direction of rotation of the transfer belt.

13. The printing method according to claim 10, further comprising:

irradiating the printing medium supported by the supporting member with light from a fourth irradiation unit, wherein the light is configured to cure the light-curable liquid and wherein the fourth irradiation unit is disposed in the supporting member.

14. The printing method according to claim 10, wherein the light for curing the light-curable liquid emitted from the second irradiation unit is ultra violet light.

15. The printing method according to claim 14, wherein the light-curable liquid which is discharged from the print head is ultra-violet-light-curable ink.

16. The printing method according to claim 10, wherein the non-rotational contact member contacts the inner peripheral surface of the transfer belt to bend the transfer belt at an angle of smaller than or equal to 60°.

* * * * *